United States Patent [19]

Katz

[11] Patent Number: 4,773,785

[45] Date of Patent: Sep. 27, 1988

[54] BRUSH WITH MEANS FOR RELEASING A FLOWABLE MEDIUM

[76] Inventor: Otto Katz, Michael-Kuper-Str. 3 a, 8540 Schwabach, Fed. Rep. of Germany

[21] Appl. No.: 926,962

[22] Filed: Nov. 3, 1986

[30] Foreign Application Priority Data

Nov. 3, 1985 [DE] Fed. Rep. of Germany ..... 3629627

[51] Int. Cl.[4] ..... A46B 11/02

[52] U.S. Cl. ..... 401/101; 401/99; 401/151; 401/270; 401/272; 401/274

[58] Field of Search ..... 401/99, 101, 109, 272, 401/274, 268, 270, 151, 115

[56] References Cited

U.S. PATENT DOCUMENTS

| | | | |
|---|---|---|---|
| 371,899 | 10/1887 | Osborne | 401/270 X |
| 1,184,662 | 5/1916 | Semple | 401/274 |
| 2,425,143 | 8/1947 | Brubaker | 401/151 |
| 2,485,494 | 10/1949 | Jockers | 401/274 X |
| 2,630,593 | 8/1953 | Jockers | 401/274 X |
| 2,789,304 | 4/1957 | Leavin | 401/109 X |
| 3,144,676 | 8/1964 | Lamura | 401/151 X |
| 3,192,552 | 7/1965 | King | 401/270 X |
| 3,420,611 | 1/1969 | Towns | 401/115 |
| 3,969,028 | 7/1976 | Negreiros | 401/279 |
| 4,043,681 | 8/1977 | Funahashi | 401/151 |

FOREIGN PATENT DOCUMENTS

| | | | |
|---|---|---|---|
| 962732 | 6/1950 | France | 401/104 |
| 1128625 | 1/1957 | France | 401/104 |

*Primary Examiner*—Steven A. Bratlie
*Attorney, Agent, or Firm*—Michael J. Striker

[57] ABSTRACT

A pin-shaped device for releasing a flowable medium comprises a housing having front and rear ends and an axis, a brush-like application element arranged to extend through the front end of the housing and displaceable in a an axial direction, a piston rod arranged to displace the application element, the piston rod being axially movable in a guiding opening of the housing, a pressure spring acting upon the piston rod so that the piston rod is movable in the guiding opening under the action of the pressure spring, a dosing piston being in communication with the application element, a control piston formed so that the control piston and the application element are fixedly connected with the piston rod, while the dosing piston is axially movable relative to the piston rod, a supply chamber and a dosing chamber formed in the housing and connected with one another such that the dosing chamber is alternatingly closable during the movement of the piston rod at axially opposite ends, and a sealing ring and a sealing cylinder arranged so that the control piston abuts at one end of the dosing chamber against the sealing ring, while the dosing piston lies at an opposite end of the dosing chamber in the sealing cylinder.

20 Claims, 3 Drawing Sheets

BRUSH WITH MEANS FOR RELEASING A FLOWABLE MEDIUM

BACKGROUND OF THE INVENTION

The present invention relates to a pin-shaped device for releasing a flowable medium from a supply container with a brush-like application element. More particularly, it relates to such a device in which the application element is displaceable through a closable opening of a front of the device by means of a piston rod acting against a spring force and communicating with a dosing piston in a chamber provided at the end side of the supply container.

The application element in form of a brush or another conventional fiber writing tip must be supplied during each actuation of the device with a predetermined quantity of a flowable medium. It must be guaranteed that the flowable medium cannot be dried in the supply chamber and in the dosing chamber. Fast drying with the removed closing cap in the supply opening into which the application element is withdrawn must be prevented.

The U.S. Pat. No. 3,144,676 discloses a pin-shaped device for applying liquids by means of a brush. The liquid is supplied from a supply chamber via a dosing chamber or the like to the brush. Since in this device no actuating element is provided, the brush is moved from the dosing chamber only with the tip facing upwardly, under the action of the force of gravity. In this position the dosing chamber is not closed, so that during the operation or when the device is left open with projecting brush, drying in the dosing chamber can take place.

For applying flowable cosmetics substances, a further device is disclosed in the Japanese document number CHO 60-8803. FIGS. 2 and 3 of this document show a pin-shaped device in which the application element is connected with a throughgoing piston rod. The piston rod can be axially displaceable at the rear end of the pin by rotation. The application pin contains also a supply chamber and a dosing chamber. During the forward movement of the piston rod a throughopening from the supply chamber to the dosing chamber is released for filling the dosing chamber with liquid. Moreover, during the forward movement of the piston rod a dosing piston or the like is actuated, which supplies a suction pad or a sponge arranged in the supply opening with the liquid. From this sponge the liquid is transferred to the application element. This device has the disadvantage that in the inoperative position the dosing chamber is not closed from air entrance. There is, therefore, the danger that the liquid can be dried in the dosing chamber.

SUMMARY OF THE INVENTION

Accordingly, it is an object of the present invention to provide a pin-shaped device for releasing a flowable medium which avoids the disadvantages of the prior art.

More particularly, it is an object of the present invention to provide a device for releasing a flowable medium from a container in which the function of dosing is guaranteed and in which the medium cannot be dried in the supply chamber and dosing chamber with reliability. Moreover, the application element can be protected from drying as well.

In keeping with these objects and with others which will become apparent hereinafter, one feature of the present invention resides, briefly stated, in that the device is provided with a control piston which is fixedly connected with a throughgoing piston rod which carries also the application element, and also provided with a movable dosing piston on the piston rod. It is, therefore guaranteed, that both the supply chamber and the dosing chamber are always sealed from the outer air.

The supply chamber is sealed from the piston rod by means of a sealing ring and the chamber is sealed by means of a further sealing ring relative to the control piston, so that the sealing action is increased. An additional sealing of the supply chamber from the outer air is achieved by a construction in which the dosing piston abuts against an outer surface of the control piston by means of an inner cone and carries on its outer periphery a sealing element which is complementary to a sealing cylinder. The dosing chamber is thereby sealed relative to the piston rod in the inoperative position.

In accordance with a further advantageous embodiment of the invention, the dosed quantity of the flowable medium is exactly determined and changed in a simple manner exclusively by change of the control piston, in correspondence with the properties of the flowable medium. This is achieved when the axial path of the piston rod is greater than the length of the control piston and greater than the axial path of the dosing piston, while the length of the control piston and the axial path of the dosing piston are different.

For adding air to the volume of the discharge medium in the supply chamber, a valve is provided which allows a pressure and volume equalization of the pressure differences between the outer atmosphere and the interior of the supply chamber. It is advantageous to provide a conical ring-shaped groove in the intermediate wall which closes the supply chamber from behind, such that the ring-shaped groove narrows toward rear end of the housing and carries a ring-shaped seal. The ring-shaped seal abuts against the piston rod and the ring-shaped groove is formed wider than the ring-shaped seal in the direction of the conical region.

A positive sealing of the supply chamber from outside can be achieved in an advantageous manner when the dosing piston has a supporting pipe which in the initial position of the piston rod abuts against the ring sealing under the action of the pressure spring. The force of the return spring of the piston rod is used so that in the inoperative position the dosing chamber is sealed.

In accordance with a further advantageous feature of the invention, the supply chamber is sealed by a diaphragm valve relative to the piston rod. It is mounted in a throughflow bush by means of a valve bush in an outer diameter portion, and abuts in the initial position of the piston rod against the supporting pipe with an inner diameter portion. The diaphragm valve has the advantage that it easily reacts to pressure differences.

The sealing on the dosing piston can be improved in an advantageous manner without changing the principle of the device, when a sealing is used to seal the inner and outer diameter. In an advantageous manner, a further diaphragm-like sealing element is mounted between the dosing piston and the supporting pipe. Its inner diameter portion abuts against the piston rod and its outer diameter portion abuts against the sealing cylinder.

The inventive device can be adjusted in a simple manner to different viscosities of the media to be used, when the connection between the supply chamber and the dosing chamber is performed through a throughflow bush which is supported by means of a ring-shaped flange and an intermediate bush in the housing and provided with one or several overflow surfaces. The outer dimensions of the throughflow bush can be retained unchanged, so that the automatically mounted device can remain the same with respect to the number and dimensions of the used parts. At the same time, by the change of one individual part, it can be adjusted to the properties of the flowable medium.

For preventing advancement of a medium in a horizontal position of the device when the supply chamber is only partially filled, capillary channels can advantageously be provided and formed as an intermediate storage. An advantageous embodiment of this intermediate storage is achieved when the communication from the supply to the dosing chamber is performed through a throughflow bush which is supported by means of a ring-shaped flange and an intermediate bush in the housing and which has one or several overflow passages.

In order to enable filling the device with different media, the changes must be made only in the dosing piston and the throughflow bush. In an advantageous manner, a premounted structural unit can be provided which contains changeable parts, while the remaining parts of the device remain the same. In accordance with a further embodiment of the invention, a structural group is formed so that the intermediate bush serves for supporting the front part, the cylinder bush and the throughflow bush and is inserted in the housing.

An especially simple dosing is achieved when it is performed not only by friction, but also under the action of a predetermined force. The dosing force can be adjusted accurately when, in accordance with a further embodiment of the invention, a dosing spring acts with its end upon the dosing piston, extends through the throughflow bush, and is supported with its opposite end against a housing-fixed supporting wall.

For avoiding actuation of the device and dosing of a flowable medium with fitted closure cap, another advantageous embodiment of the device provides that the piston rod is mounted in a guided piston which is displaceable along an inner wall of the housing and has a coupling piece for receiving a closure cap. The device can be actuated only after plugging of the closure cap. A further advantage is obtained for the user when the closing cap can be placed on the rear end of the device and not lost. Simultaneously, also an improved guidance of the piston rod is achieved when it is supported in the guiding piston.

For facilitating the operation by the user, an arresting device is provided which is known in the ball-type writing instruments for adjusting the writing lead. With the above arresting device, the application element, similarly to a ball writing lead, can be extended from the housing and locked in this position. The above arresting device can be designed in a very simple manner when it includes an arresting element displaceable transversely to the movement direction of the piston rod under the action of a spring in a cutout and fixable by a releasing pin.

In accordance with a further embodiment of the invention, an abutment disk is mounted fixedly on the piston rod and abuts with its one side under the action of the pressure spring against the intermediate wall of the housing, while at its opposite side it abuts against the dosing spring which in turn presses with its another end against a supporting ring connected with a sealing element and a dosing piston. In this manner it is possible to retain very low the spring force of the dosing spring and particularly its pretensioning in the initial position. The dosing spring is pretensioned during the movement of the piston rod, until it is in the position to move the dosing piston. This provides the advantage that a small spring force is obtained for the pressure spring as well, which brings the piston rod to the initial position. The device is easy to handle with these structural features.

When the abutment disk is designed so that it has several openings extending parallel to its center axis, a further advantage is provided. The flowing medium in the supply container is pressed during movement of the piston rod through the openings and changes the viscosity of the medium with the use of the thixotropie effect.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
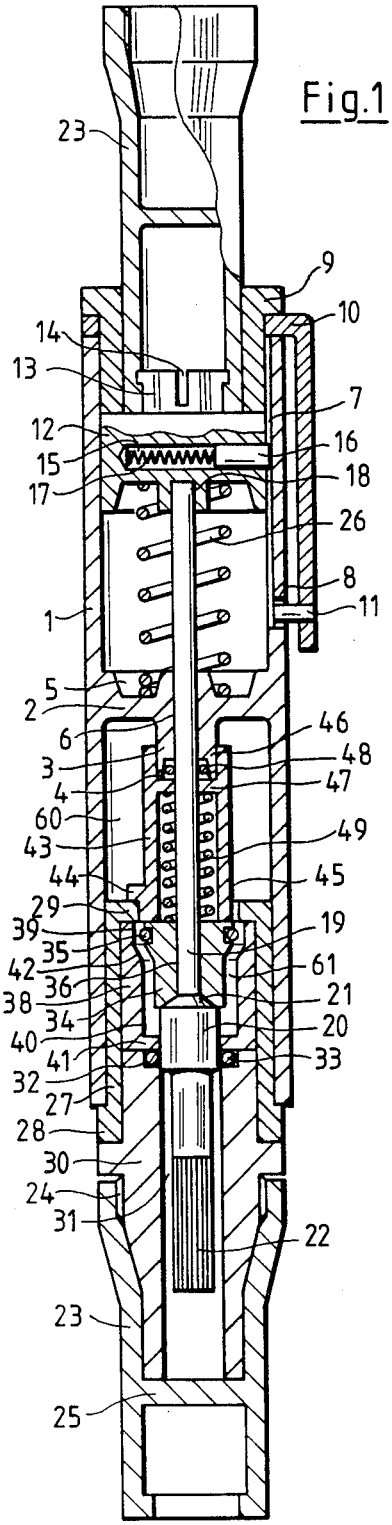
FIG. 1 is a view showing a longitudinal section of a device for releasing a flowable medium in accordance with the present invention, with a withdrawn application element.

A device for releasing and applying a flowable medium shown in FIG. 1 includes a housing 1 which has an intermediate wall 2 with a flange 3 formed on the latter. The flange 3 is provided with a conical annular groove 4 and a ring-shaped spring-receiving depression 5. The intermediate wall 2 has a guiding opening 6, and also a longitudinal groove 7 provided in the rear region of the housing 1 and ending in a cutout 8.

As shown in the drawing, the housing 1 is closed by a collar bush 9 which is pressed and glued to the housing. The collar bush 9 serves for mounting an annular clip 10 which carries at its springy clip leg a releasing pin 11. The housing 1 has a chamber which is located above the intermediate wall 2 and accommodates a guiding piston 12 which is provided with a coupling piece 13 having a slot 14. The guiding piston 12 has a transverse opening 15 for an arresting element 16 which abuts against a spring 17. The guiding pin 12 also has a blind hole 18 for mounting an end of a piston rod 19.

The piston rod 19 has a length which approximately corresponds to the length of the housing 1 and carries in its front region a thickened portion formed as a control piston 20, which is connected with the piston rod 19 by an outer cone 21. The piston rod 19 carries at its free end an application element 22. The application element 22 preferably is formed as a brush. However, it can also be formed as a fiber tip which can be used as known painting tips.

The housing 1 is closed at its front end by a closing cap 23 which is connected with the housing by a thread 24 and abuts against a part of the housing 1 with its sealing wall 25. The piston 19 is held in its end position by a pressure spring 26 which urges the guiding piston 12 toward abutment against the collar bush 9.

An intermediate bush 27 is mounted on the front end of the housing 1. It has an outwardly extended crank-shaped flange 28 and a further ring-shaped flange 29 extending inwardly. A front part 30 is inserted into the above intermediate bush 27. A supply opening 31 is provided in the front part 30 and extends rearwardly so as to form a ring-shaped recess 32. This recess 32 accommodates a sealing ring 33 which abuts against the control piston 20 in the inoperative position.

A dosing piston 34 is arranged axially movably on the piston rod 19 in an opening 36. The dosing piston 34 carries on its outer periphery a sealing element 35. It is also provided at its front end with an inner cone 37 which is complementary to the outer cone 21 of the control piston 20. The dosing piston 34 is located inside a cylinder bush 38 which has a throughflow cylinder 39 and a sealing cylinder 40 connected with one another by a running incline 42. Furthermore, the cylinder bush 38 has at its end side a supporting flange 41 which can be brought to abutment against the dosing piston 34.

Figure 4:
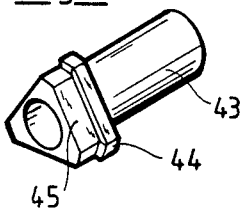
FIG. 4 is a perspective view of a throughflow bush of the device in accordance with the present invention.

A throughflow bush 43 is arranged in the inner ring-shaped flange 29 of the intermediate bush 27. The throughflow openings are formed by overflow surfaces 45 as shown more clearly in FIG. 4. The throughflow bush 43 is guided at its opposite end on the flange 3 of the intermediate wall 2. For this purpose it is provided with a supporting wall 47 which closes the conical annular groove 4 and encloses a ring-shaped sealing 48.

Figure 5:
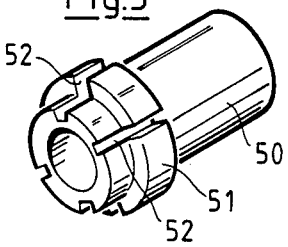
FIG. 5 is a perspective view showing the throughflow bush of the inventive device in accordance with another embodiment of the invention.

A further embodiment of a throughflow bush 50 is shown in FIG. 5. Here, it has a preformed flange 51 which is interrupted by overflow passages 52. The overflow passages 52 have the advantage that they adjust the flowing medium in an especially satisfactory manner so as to form at this location an intermediate accumulator of a kind in which a certain quantity of the medium to be applied is held to be aspirated from there.

Figure 6:
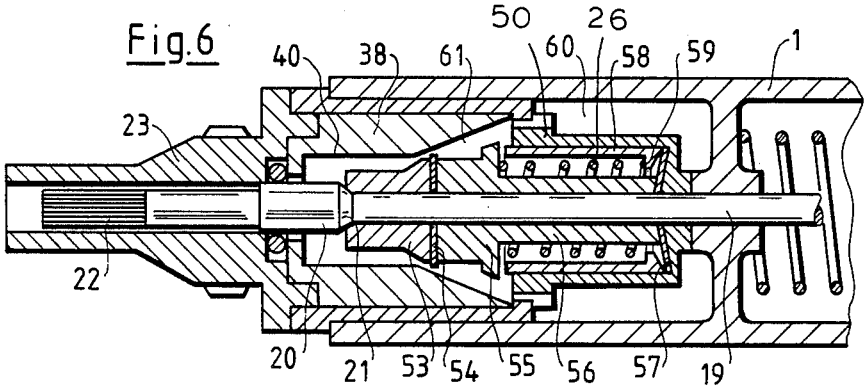
FIG. 6 is a view showing a longitudinal section of the device for releasing a flowable medium of a further embodiment, with a withdrawn application element.
Figure 7:
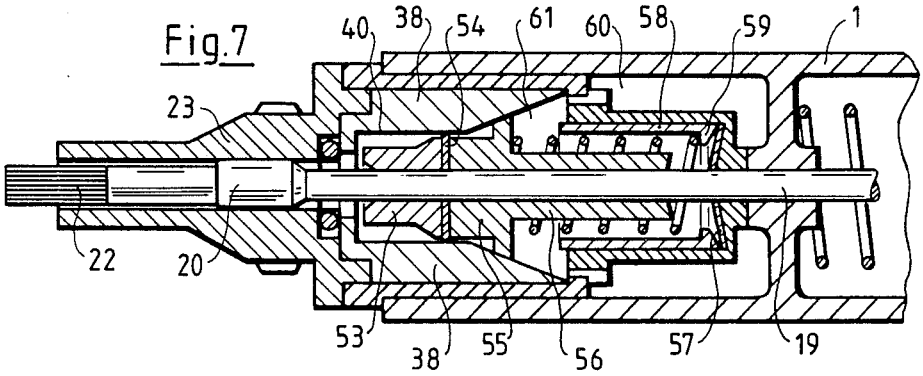
FIG. 7 is a view showing the device of FIG. 6 with the outwardly projecting application element.

FIGS. 6 and 7 show a further embodiment of the device in accordance with the present invention. It substantially corresponds to the device shown in FIG. 1, but has a different dosing piston 53. A sealing element 54 is arranged in the dosing piston 53 and held by a supporting bush 55. At the rear end of the housing 1 the supporting bush 55 is extended in form of a supporting pipe 56. A diaphragm valve 57 is pressed under the action of a pressure spring 26 by means of the piston rod 19 against the throughflow bush 50. The diaphragm valve 57 is fixed on its outer diameter by means of a valve bush 58 which has a supporting flange 59 and is pressed in the throughflow bush 50.

In condition of use of the device, a supply chamber 60 is completely filled with the flowing medium to be released. A dosing chamber 61 is provided at the discharge end of the device inside the cylinder bush 38. As can be seen from FIG. 6, in the initial position both the supply chamber 60 and the dosing chamber 61 are sealed from the atmosphere.

Figure 8:
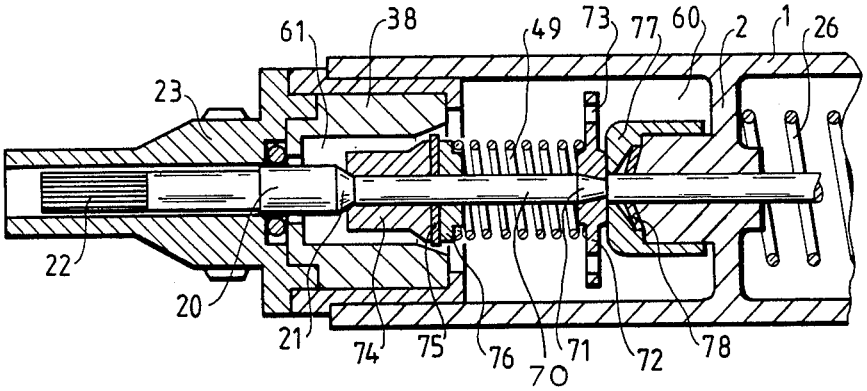
FIG. 8 is a view showing the device for releasing a flowable medium in accordance with still a further embodiment of the invention in an initial position and in the region of the dosing chamber.
Figure 9:
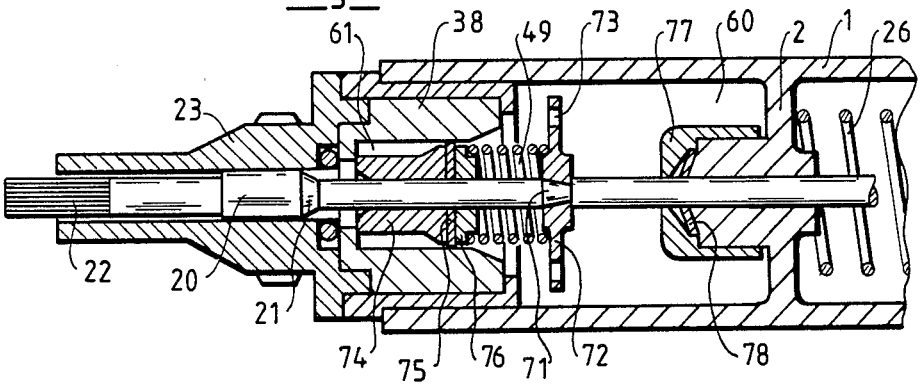
FIG. 9 is a view showing the device of FIG. 8 in the working position of its application element.

In the device in accordance with the embodiment of FIGS. 8 and 9, an abutment disk 72 is seated stationarily on a piston rod 70 and notch 71. The abutment disk 72 has a plurality of openings 73. The outer diameter of the abutment disk 72 corresponds substantially to the inner diameter of the housing 1. Also, a dosing piston 74 is provided in this embodiment and connected with a sealing element 75 and a supporting ring 76. A semi-collar 77 serves for fixing a membrane valve 78 on the intermediate wall 2.

The device for releasing a flowable medium in accordance with the present invention operates in the following manner:

For transporting the flowable medium which fills the supply chamber 60, to the application element 22 and moving the latter to the position of use, the closing cap 23 is first unscrewed and placed onto the coupling piece 13. When a force is applied onto the closing cap 23 which serves as a button, the piston rod 19 moves forwardly against the force of the spring 26. Through the piston rod 19, also the control piston 20 and the dosing piston 34 are moved axially. The sealing element 35 of the dosing piston 34 runs on the running incline 42. The dosing piston 34 is thereby held, while the piston rod 19 and the control piston 20 are moved further forwardly. As long as the control piston 20 leaves the sealing ring 33, the medium can not be pressed from the dosing chamber 61 into the supply opening 31. After opening the dosing chamber 61, the dosing spring 49 is in the position such that the dosing piston 34 is moved in the sealing cylinder 40 and the medium is supplied to the supply opening 31. The path of the dosing piston 34 is identified with reference letter H in FIG. 2.

Figure 2:
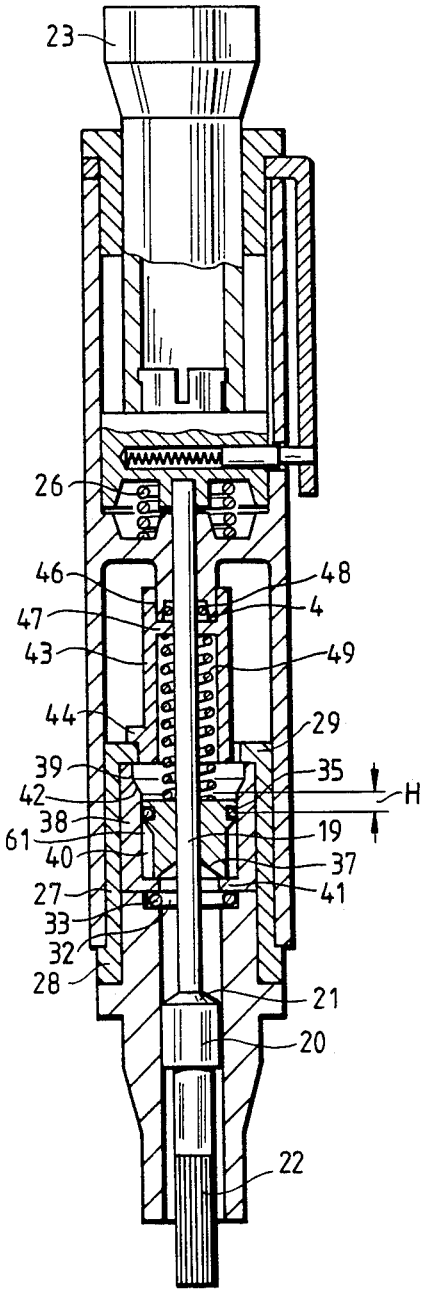
FIG. 2 is a view showing the device of FIG. 1 with the application element in the position of use.
Figure 3:
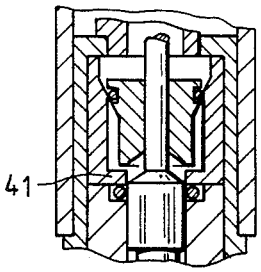
FIG. 3 is a longitudinal section showing the device during the beginning of a dosing process.

At the end of the forward movement of the piston rod 19, the arresting element 16 is pressed by means of the spring 17 in the cutout 8 and arrests the guiding piston 12 in its front position. In this position which is shown in FIG. 2 the application element 22 projects beyond the front part 30 and is in the position ready to use. The application element 22 is filled with the medium since as shown in FIGS. 1, 2 and 3 during multi-actuation of the piston rod 19 the supply opening 31 is partially filled with the medium discharged to the application element 22.

For adding air to the medium which is supplied from the supply chamber 60, the ring-shaped sealing 48 is provided. It enables an air admixture to the supply chamber 60. The negative pressure which is formed in the supply chamber 60 when the dosing piston 34 is moved into the sealing cylinder 40, contributes to an air exchange. The atmospheric pressure is then greater than the pressure inside the supply chamber 60, so that because of the conical design of the annular groove 4 an air supply from outside inwardly can take place.

For withdrawing the piston rod 19, the releasing pin 11 is pressed into the cutout 8 and the arresting element 16 is unblocked. The piston rod 19 is brought under the action of the pressure spring 26 to its initial position. The guiding piston 12 abuts again against the collar bush 9.

In the embodiment shown in FIGS. 6 and 7 the same operation of the pin-shaped device for application of a flowable medium takes place. The advantage of this construction is that directly behind the differently designed dosing piston 53, the sealing element 54 is arranged and formed as a diaphragm. The sealing element 54 abuts simultaneously against the sealing cylinder 40 and the outer diameter of the piston rod 19. In this manner an additional sealing of the dosing chamber 61 from the atmosphere is achieved. Moreover, in the inoperative position shown in FIG. 6, a forced sealing by the membrane valve 57 is provided, since the supporting pipe 56 under the action of the pressure spring 26 acts upon the second diaphragm valve 57 and closes the same in force-transmitting manner in the inoperative position. When the application element 22 projects from the supply opening 31, a pressure equalization can be carried through the diaphragm valve 57 as long as a negative pressure takes places in the supply chamber 60. The diaphragm valve 57 can be designed so that it reacts in a very pressure-sensitive manner.

The device shown in FIGS. 8 and 9 functions in principle in the same manner as the above described devices. This further embodiment makes possible to reduce the forces for actuation of the dosing and arresting unit and thereby to provide the user with a product which is especially easy to handle. The dosing spring 49 must act in this embodiment not with the help of its pretensioning upon the dosing stroke H. The spring force is required only for bringing the dosing piston 74 against the piston rod 70 in its initial position shown in FIG. 8. During displacement of the piston rod 70, the abutment disk 72 is moved and a pretensioning of the dosing spring 49 is formed until it is in the position in which the dosing piston 74, including its sealing element 75, is to be displaced. The device can also be designed so that the dosing spring 49 is compressed to a block length and only thereafter the movement of the dosing piston 74 is obtained. In the last case the dosing stroke can be brought directly by the user. The pressure spring 26 can, therefore, be designed so that it has to overcome the return forces for moving the piston rod 70 with connected individual parts.

Also, in this embodiment the piston rod 70 is first advanced axially until the control piston 20 leaves the sealing 33. After this either a pretensioning of the dosing spring 49 is formed, or alternatingly the dosing spring 49 is compressed to the block length. With the sufficient pretensioning or block length, the dosing piston 74 can be moved by a predetermined stroke. Since during this movement the abutment disk 72 is moved into the supply chamber 60, simultaneously because of the opening 73 the flowable medium is moved. In the event of thixotropous media, the desired change of the viscosity takes place, which leads to a favorable flow condition. The medium is moved by the dosing piston 74 into the supply opening 31, and then it is brought in communication with the application element 22 when it is withdrawn to the position shown in FIG. 8.

It will be understood that each of the elements described above, or two or more together, may also find a useful application in other types of constructions differing from the types described above.

While the invention has been illustrated and described as embodied in a pin-shaped device for applying a flowable medium, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A pin-shaped device for releasing a flowable medium, comprising a housing having front and rear ends and an axis; a brush-like application element arranged to extend through said front end of said housing and displaceable in an axial direction; a piston rod arranged to displace said application element, said housing having an intermediate wall provided with a guiding opening, said piston rod being axially movable in said guiding opening; a pressure spring acting upon said piston rod so that said piston rod is movable in said guiding opening under the action of said pressure spring; a dosing piston being in communication with said application element; a control piston, said control piston and said application element being fixedly connected with said piston rod, while said dosing piston being axially movable relative to said piston rod; a supply chamber and a dosing chamber formed in said housing and connected with one another, said dosing chamber being alternatingly closable during the movement of the piston rod at axially opposite ends; and a sealing ring and a sealing cylinder arranged so that said control piston abuts at one end of said dosing chamber against said sealing ring, while said dosing piston lies at an opposite end of said dosing chamber in said sealing cylinder.

2. A pin-shaped device as defined in claim 1; and further comprising means for sealing said supply chamber at opposite ends, said sealing means including a ring-shaped sealing member arranged on said piston rod and sealing the supply chamber at its one end.

3. A pin-shaped device as defined in claim 2, wherein said sealing means also include a sealing ring provided in said dosing chamber and sealing by means of said control piston said supply chamber at the other end.

4. A pin-shaped device as defined in claim 2, wherein said sealing means also include a sealing cylinder arranged so that said supply chamber is sealed at the other end by means of said dosing piston.

5. A pin-shaped device as defined in claim 4, wherein said control piston has an outer conical surface, said dosing piston having an inner conical surface abutting against said outer conical surface of said control piston, said dosing piston carrying a sealing element which is complementary to said sealing cylinder.

6. A pin-shaped device as defined in claim 1, wherein said control piston has a predetermined axial length, said dosing piston having a predetermined axial path which is different from said length of said control piston, said piston rod having an axial path which is greater than said length of said control piston and greater than said axial path of said dosing piston.

7. A pin-shaped device as defined in claim 1, wherein said intermediate wall closes said supply chamber from behind and has a conical annular groove reducing toward said rear end of said housing; and further comprising a ring-shaped sealing member arranged in said conical ring-shaped groove so that said piston rod abuts against said ring-shaped sealing member, said ring-shaped groove being wider than said ring-shaped sealing member in direction of its conical region.

8. A pin-shaped device as defined in claim 7, wherein said dosing piston has a supporting pipe which in an initial position of said piston rod abuts against said ring-shaped sealing member under the action said pressure spring.

9. A pin-shaped device as defined in claim 8; and further comprising a diaphragm valve which seals said supply chamber relative to said piston rod and has a valve bush, and a through-flow bush, said diaphragm valve having an outer diameter part which is mounted in said throughflow bush by means of said valve bush, and an inner diameter portion which in an initial position of said piston rod abuts against said supporting pipe.

10. A pin-shaped device as defined in claim 8, and further comprising a diaphragm-like sealing element arranged between said dosing piston and said supporting pipe and having an inner diameter portion which abuts against said piston rod and an outer diameter portion which abuts against said sealing cylinder.

11. A pin-shaped device as defined in claim 1; and further comprising a throughflow bush forming a communication between said supply chamber and said dosing chamber, a ring-shaped flange and an intermediate bush arranged so that said throughflow bush is supported in said housing by said ring-shaped flange and said intermediate bush, said throughflow bush having at least one overflow surface.

12. A pin-shaped device as defined in claim ll, wherein said throughflow bush communicating said supply chamber with said dosing chamber has a plurality of such overflow surfaces.

13. A pin-shaped device as defined in claim 1; and further comprising a front part, a cylinder bush, a throughflow bush communicating said supply chamber with said dosing chamber, and an intermediate bush which supports said front part, said cylinder bush and said throughflow bush and is insertable in said housing.

14. A pin-shaped device as defined in claim 1; and further comprising a throughflow bush communicating said supply chamber with said dosing chamber, a dosing spring having two ends and guided in said throughflow bush, and a supporting wall fixedly connected with said housing, said dosing spring having one end with which it abuts against said dosing piston and another end with which it abuts against said supporting wall.

15. A pin-shaped device as defined in claim 14, wherein said dosing spring has a predetermined spring force, said pressure spring located between said housing and said piston rod having a force which is greater than said spring force of said dosing spring.

16. A pin-shaped device as defined in claim 1, wherein said housing has an inner wall; and further comprising a closing cap which closes said housing, and a guiding piston which is mounted on said piston rod and displaceable along said inner wall of said housing, said guiding piston having a coupling piece for receiving said closing cap.

17. A pin-shaped device as defined in claim 1, wherein said housing has a front part provided with a supply opening, said piston rod being movable between two positions in which said application element projects outwardly beyond said front part and in which said application element is completely withdrawn into said supply opening, respectively; and arresting means arranged for arresting said piston rod in said two end positions.

18. A pin-shaped device as defined in claim 1, wherein said housing has an intermediate wall through which said piston rod extends, said piston rod being provided with an abutment disk fixedly mounted thereon and having two end sides, said abutment disk being arranged so that its one end side abuts against said intermediate wall of said housing; and further comprising a dosing spring arranged between said abutment disk and said dosing piston, the other end side of said abutment disk forming an abutment for said dosing spring.

19. A pin-shaped device as defined in claim 18, wherein said abutment disk has a central axis and a plurality of openings extending parallel to said central axis.

20. A pin-shaped device as defined in claim 18, wherein said piston rod has a notch, said abutment disk being axially fixed on said notch of said piston rod.

* * * * *